US005152472A

United States Patent [19]

Spang et al.

[11] Patent Number: 5,152,472

[45] Date of Patent: Oct. 6, 1992

[54] PRINTING ROLL CHANGER SYSTEM, AND METHOD OF ROLL CHANGING

[75] Inventors: Otto Spang, Margertshausen; Hans Mamberer, Königsbrunn, both of Fed. Rep. of Germany

[73] Assignee: Man Roland Druckmaschinen AG, Offenbach am Main, Fed. Rep. of Germany

[21] Appl. No.: 636,574

[22] Filed: Jan. 2, 1991

[30] Foreign Application Priority Data

Jan. 12, 1990 [DE] Fed. Rep. of Germany ..... 4000745

[51] Int. Cl.[5] ..... B65H 19/18; B65H 19/20

[52] U.S. Cl. ..... 242/58.3; 242/58.1

[58] Field of Search ..... 242/58.3, 58.2, 58.1, 242/58.4

[56] References Cited

U.S. PATENT DOCUMENTS

| | | | |
|---|---|---|---|
| 3,103,320 | 9/1963 | Huck | 242/58.3 |
| 3,554,829 | 1/1971 | Luckett, Sr. | 156/157 |
| 4,077,580 | 3/1978 | Lang et al. | 242/58.3 |
| 4,082,589 | 4/1978 | Patterson et al. | 242/58.5 |
| 4,286,756 | 9/1981 | Vits | 242/58.1 |
| 4,564,149 | 1/1986 | Barzano | 242/58.3 |
| 4,637,149 | 1/1987 | Rivkin | 40/594 |

FOREIGN PATENT DOCUMENTS

| | | |
|---|---|---|
| 2224733 | 12/1973 | Fed. Rep. of Germany . |
| 7234802 | 10/1975 | Fed. Rep. of Germany . |
| 2619236 | 11/1977 | Fed. Rep. of Germany . |

*Primary Examiner*—Daniel P. Stodola
*Assistant Examiner*—John Q. Nguyen
*Attorney, Agent, or Firm*—Frishauf, Holtz, Goodman & Woodward

[57] ABSTRACT

To permit essentially automatic control of roll changing to change between an old roll and a replacement roll of printing machine paper, adhesive is applied to the old roll, at predetermined locations, as the old roll runs off, and the now sticky surface is engaged against the beginning portion from the new roll, the old roll then being severed within the range of the still sticky portion to ensure complete adhesion of substrate from the old roll on the substrate of the new roll. Excess adhesive which is not covered by substrate from a new roll is deactivated by a deactivating element (7) positioned in advance of any deflection roller to prevent accumulation of adhesive on any elements of the roll changer of the printing machine.

10 Claims, 1 Drawing Sheet

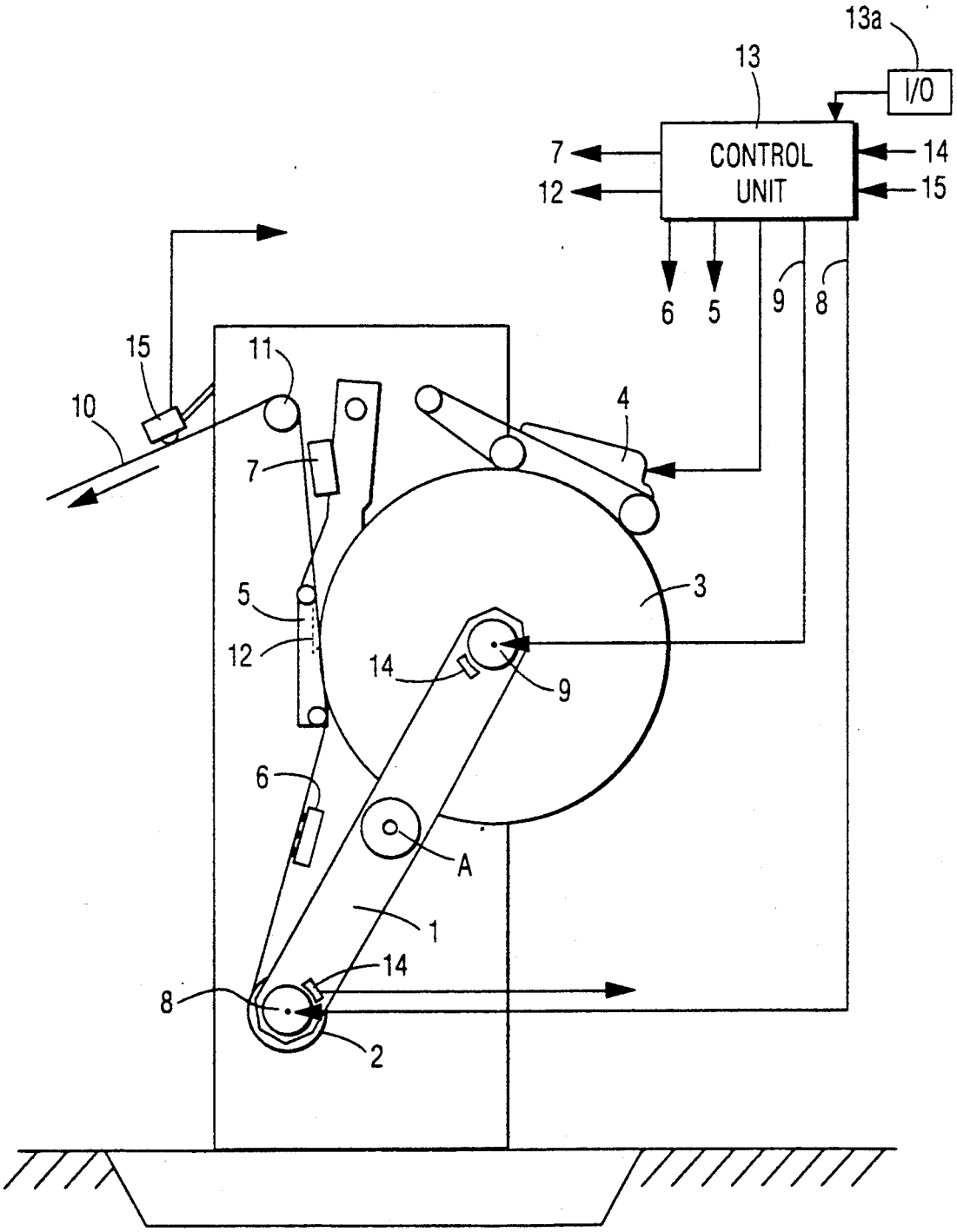
13a
13
I/O
CONTROL UNIT
7
12
14
15
6
5
9
8
15
11
10
4
7
3
5
12
14
9
6
A
1
14
8
2

PRINTING ROLL CHANGER SYSTEM, AND METHOD OF ROLL CHANGING

Reference to related application, assigned to the assignee of the present invention, the disclosure of which is hereby incorporated by reference: U.S. Ser. No. 07/636,685, filed Jan. 2, 1991, SPANG et al.

Reference to related publication: German Published Patent Application DE-AS 22 24 733, KETTELER U.S. Pat. No. 4,077,580, Lang et al, to which German Published Patent Application DE-AS 26 19 236, corresponds.

FIELD OF THE INVENTION

The present invention relates to printing machinery, and more particularly to accessory apparatus for rotary web printing machines, namely to roll changers to change rolls on which substrate webs, hereinafter for simplicity "paper webs", are rolled, and to a method and system to change from an existing roll over to a replacement roll.

BACKGROUND

It is known to change rolls in a rotary web fed printing machine by adhering a replacement roll on a roll then being run on the printing machine, see for example German Published Patent Application 22 24 733, Ketteler. The structure described in this reference provides for adhesion of the replacement web to the old or first or expiring web. Upon such adhesion, a short remainder length of web from the first or old roll will remain. The roll changer includes a frame, pivotable about a horizontal axis, which retains e.g. two rolls; one, the old or first roll and, further, one or more replacement rolls. The roll-off speed of the web then being handled in the printing machine is controlled, so that the tension of the web passing through the printing machine will be appropriate for printing on the paper web. Additionally, apparatus is provided to accelerate the replacement roll, and synchronize the speed of the replacement roll with the linear speed of the running-off web from the first or old roll. A brush applies the old web against an adhesive tip on the new roll. A knife is provided for severing the remainder of the old web when the old web and the replacement web have been adhered.

Control of the rolls is carried out electronically, by providing an electronic pulse source which provides a pulse train which can indicate the position where adhesive is to be applied on the replacement roll and, additionally, controls the brush to press the old web on the new web. The knife to cut off the remaining flap of the old web is also controlled by the electronic control system. The pulses of the pulse train are evaluated by digital counters, timing elements, or the like.

The system, as heretofore used, includes a replacement roll which first has an adhesive applied thereto, and which is fitted on the frame of the roll changer. To initiate a roll or web change, the adhesive is pre-applied as an adhesive tip on the replacement roll and the web from the first or old or expiring roll is then pressed by a brush against the replacement roll which, at that time, has been accelerated to the running speed required to roll the web off the replacement roll and feed it to a printing machine. The old roll, in effect, engages or grips the beginning of the new roll which is to be pulled off, and carries it along; the expiring web pulls off the replacement web from the replacement roll, thereby initiating rolling off of the replacement web from the replacement roll. The cutter apparatus severs the web of the old roll from the now effectively dual webs. This leaves a web portion or flap of the old or expiring roll, which is pulled by the printing machine into the printing stations.

It has been found that this loose flap can catch in the printing stations and may lead to damage in the printing machines; under extreme conditions it may lead to tearing of the web which includes tearing of the replacement web, which can deposit itself somewhere within the printing machine system, to interfere with printing and/or cause shut-down of the entire printing machine system to remove the misfeed of paper in the printing machine.

THE INVENTION

It is an object to provide a roll changer system and a roll changing method, in which, upon change of webs from an old roll to a replacement roll, loose paper flaps and loose paper portions are effectively eliminated.

Briefly, rather than applying adhesive on the replacement roll, the adhesive is applied on a surface of the running-off or expiring roll at a surface side thereof which faces the substrate of the replacement roll. Upon then engaging the web of the running-off, old roll and the web from the replacement roll against each other, the webs are adhered. The application of adhesive to the old or expiring web and engagement of the old and new webs can be carried out precisely at predetermined positions so that the old web can be readily cut immediately behind the adhesive portion. Thus, loose end flaps are prevented from entering into the printing machine and damage to the printing machine is effectively avoided.

DRAWING

The single FIGURE is a highly schematic side view of the roll changer of the present invention, and is also used in explaining the method of the present invention.

DETAILED DESCRIPTION

A frame 1, which includes a double-arm lever, carries two paper rolls 2, 3, at respective ends of the arm. A paper web 10 is spooled off the roll 2, applied, for example, to a rotary printing machine. If the paper being applied to the printing machine is to be changed, or if the expiring web from roll 2 is about to run out, a replacement web from roll 3 is fed to the printing machine. The rolls 2, 3 can be pivoted about a horizontal axis, schematically shown at A. A drive system is engageable with the respective roll which delivers the web to the printing machine; this drive system, for example, is a belt drive 4, which forms, simultaneously, a drive and braking arrangement. It provides constant roll-off speed of the respective web from the roll in engagement with the drive and braking system 4; further, it can be used to accelerate the roll 3 to the run-off speed when the web on roll 3 is to be adhered to the web 10 rolled off the old roll 2.

A web engagement and cutter system 5 is provided of sufficient linear extent to engage the end portion of the web 10 from the roll 2 to the initial portion of the web on the replacement roll 3 and then cut the web from roll 2. An adhesive application system 6 is provided and, in accordance with a feature of the invention, there is an adhesive deactivating arrangement 7. Additional drive and braking, for example dynamic braking, systems 8, 9 are coupled to the shafts of the rolls 2, 3, respectively. Sensors 14 provide pulse output signals representative of the rotation and speed of the shafts of the rolls 2, 3; a web length sensor 15 is coupled to the web 10, responding to, selectively, length of the web being supplied and, if desired, markers placed on the web.

Operation, and method of roll changing and web adhesion

To change rolls, the frame 1 is pivoted such that the roll 2 is placed in the lower position, as shown in the drawing, which, at the same time, moves the replacement roll 3 in the upper position, as shown. Adhesive is applied from the adhesive applicator 6 on the web 10. The replacement roll 3 had been, and continues to be accelerated to the roll-off speed. The running-off web 2 is then engaged against the circumference of the replacement roll 3, to adhere the web 10 from roll 2 at the initial end portion of the web on roll 3. The web 10 from the roll 2, then, is severed beyond the adhesion region.

In accordance with a feature of the invention, the adhesive is applied by spraying, using an adhesive spray applicator 6 positioned transversely to the run-off direction of the web 10, and including a plurality of independently controllable adhesive spray elements, for example nozzles. The web 10 from roll 2 is cut within the region which has adhesive applied thereto, so that no loose flaps of web will result. The knife 12 of the web engagement and cutter arrangement 5 is so controlled that the cut is applied against a trailing region of the portion of the web from roll 2, which has adhesive applied thereto; the cutting depth is just sufficient to cut off the web 10 being run off roll 2, without, however, damaging the web from the replacement rolls 3.

After the web 10 has passed the web engagement and cutter system 5, it is guided along a web adhesive deactivating system 7, in order to neutralize or deactivate any adhesive which may not have been covered by the replacement web from roll 3, and in advance of where the (now replacement) web comes in engagement with any other element or roller, for example the deflection roller 11.

In accordance with another embodiment of the invention, the adhesive 6 can be controlled by pulses from a well known pulse control system so that the beginning of the surface at which adhesive is applied accurately matches the starting edge of the web on replacement roll 3 which is to be adhered.

The entire sequence of roll changes is controlled by a control unit 13. The control unit 13 is coupled to the elements to be controlled, by receiving control signals as well as sensed signals from the web changing apparatus. Thus, the control unit controls the first drive and braking apparatus 4, the respective second drive and brake system 8, or 9, respectively, the web engagement and cutter apparatus 5, the adhesive applicator apparatus 6 and, if used, the adhesive deactivating apparatus 7, as well as knife 12. The control unit receives input signals from sensors, such as rotation or speed sensors 14, each one of which is associated with one of the rolls 2, or 3, respectively, and the sensor 15 which measures speed and/or the length of the web being rolled off and supplied to a printing machine. These connections are shown schematically by the arrows applied to the control unit 13, which arrows have been given the same reference numerals as the elements which are being controlled or from which, respectively, sensing signals are derived.

As the web 10 from the old or first roll 2 is run off, the sensor 15 continuously measures how much web has been run off the roll 2. This can be done in well known manner, for example by engaging a measuring roller of known diameter against the web 10 and counting the number of revolutions. This provides to the control unit 13 a continuous train of signals which are representative of the length of the web 10 which has been rolled off and, thus, the quantity of web remaining on the roll 2 can be readily determined when the overall length of the web on roll 2 is known. This length which remains on roll 2 can be referred to as a remainder length. Upon determining, by subtraction, a first remainder length, or after rolling off a certain length of web, as determined by a printing job, the control unit 13 generates a signal which initiates roll change.

The first remainder roll length is determined by the control unit 13 when considering the run-off speed of the web and, further, considering the operating speeds of the respective apparatus component, to determine therefrom a second remainder roll length. The second remainder roll length is that length of web on roll 2 at which the web is to be adhered to the web from the replacement roll 3, and which, then, is to be severed from roll 2. This length is equal to a predetermined minimum remainder roll length. The necessary data therefor can be entered in the control unit 13 either manually by a well known input/output unit, or by machine or electronically readable data input. The data can be entered in dependence on the characteristics and data handling capabilities of the control unit 13, and further in dependence on the type and number of the materials to be handled, for example the type, size, format, or characteristics of paper on the respective rolls 2, 3, and associated characteristics requiring, possibly, special handling. Such special handling may be a specific operating speed. These data can be entered as direct quantities, as coded data, or otherwise in suitable form, either for a specific printing job, or pre-entered for a sequence of printing jobs to be carried out.

The system and method has the advantage with respect to prior art apparatus that the adhesive required to adhere the replacement web to the already running old web is applied only immediately in advance of the adhesion step, by applying the adhesive on the old web from the old or first roll 2. This limits preparation of the web on the new or second or replacement roll 3 essentially merely to remove possibly damaged outer layers and to attach the end portion of the web on roll 3 so that it can be easily separated from the roll. This is very important in actual practice because a prior calculation of the requirement during any one day, or for any one job of web material, and then to prepare the respective rolls with adhesive, no longer is necessary. This is of substantial advantage since the effective utilization period of customarily used adhesives is very short.

As can be seen, no loose flaps or trailing portions remain when the old or first web 10 form the old or first roll 2 is adhered on and then severed from the web from the replacement roll 3. Thus, no flaps will be carried into a printing machine which might catch therein, or may cause an emergency stop operation of the printing machine. Additionally, application of adhesive on the old web 10 is independent of the shape of the new end portion of the web from the new or replacement roll 3; thus, the end portion of the web on the replacement roll 3 can be shaped, for example into a triangular or point form, cut transversely or on a slant, or as desired, and as most suitable in use with the respective printing machine.

Application of adhesive on the first or old web 10 has the additional advantage that it is not necessary to specifically control the application of the adhesive across the width of the web, to leave off adhesive portions axially transversely thereto so that spaced belts of the belt drive will not be contacted by adhesive but, rather, run in the interval between adhesive stripes. Accurately controlling the adhesive application apparatus 6 with respect to the axial spacing of belts on the belt system 4 is difficult. The adhesion region between the webs is particularly subject to malfunction in printing apparatus. When the adhesive region, for example after printing, is passed through a dryer, turbulences arising in the dryer have the tendency to shrink the adhesive region from those regions where there was no adhseive applied initially, in order to leave space for operation of spaced transport belts. This is eliminated since the adhesive applied from applicator 6 can extend clearly and cleanly across the width of the web, the adhesive then being covered by the web from the replacement roll 3, and any additional adhesive which is, possibly, applied too early can be deactivated by the deactivating apparatus 7.

The arrangement of the present invention has the additional advantage that, in effect, the entire roll change can be carried out automatically by electronic commands. The control of all operating functions can be sequenced automatically, for example based on data entered in form of a program, and controlling all features of the apparatus necessary for automatically carrying out sequences of printing jobs. The control, of course, may only be partly automatic; for example, the sequence of steps can be initiated manually, from a suitable input/output unit 13*a*, by providing a start command or start signal by manual input. Semi-automatic control of the sequence of operations, with manual start, can be of advantage if a substantial number of different printing jobs are to be carried out, and high flexibility in meeting the demands for the jobs is required; for example if decisions regarding the format or width of the webs have to be made quickly, and just in advance of a roll change.

Various changes and modifications may be made within the scope of the inventive concept.

We claim:

1. Printing roll changing apparatus having a first or expiring roll (2) and a second or replacement roll (3), said system permitting continuously supplying a printing substrate or web (10), selectively, from the first roll (2) or the second, replacement roll (3) and permitting change-over of expiring web or substrate supplied from the first roll (2) to the replacement web or substrate from the second roll, said apparatus further comprising a frame (1) which is pivotable about a horizontal axis (A), said frame retaining both said first and second rolls (2, 3);

a first drive and braking means (4) located for surface engagement with said replacement roll (3) and for controlling the speed of said replacement roll upon roll-off of the replacement web therefrom to a predetermined speed value;

a second drive and braking means (8, 9) for controlling the speed of said first roll (2) independently of said first drive and braking means (4);

an adhesive application means (6); and a roll engagement and web severing means (5), positioned for engaging the expiring web of said first roll (2) with the replacement web on the second roll (3) upon adhering the webs of said rolls together when changing over between said rolls, and to sever the expiring web from the first roll (2), and wherein the adhesive application means (6) is positioned with respect to the expiring web rolled from the first roll to apply web adhesive on a portion of the expiring web from the first roll and on that surface of the expiring web rolled from the first roll (2) which faces the second roll (3) and the replacement web thereon;

wherein said roll engagement and web severing means (5) has a linear engagement range along the length of the web, with respect to the direction of roll-off of said expiring web from the first roll (2) to provide for adhesion of the expiring web from the first roll to the replacement web on the second roll; and wherein said roll engagement and web severing means (5) includes a cutting knife (12), which cutting knife is positioned, with respect to said roll-off direction of the expiring web, downstream of said adhesive application means (6) to cut a trailing region of said portion of the expiring web from the first roll (2) upon adhesion of said expiring web from the first roll onto the replacement web from the second roll and within the portion of the expiring web which has adhesive applied thereto by said adhesive application means (6), and within which portion the replacement web from the second roll (3) adheres to the expiring web from the first roll (2).

2. The apparatus of claim 1, wherein said first drive and braking means (4) comprises a belt drive engageable against the circumference of said second roll.

3. The apparatus of claim 1, further including an adhesive deactivating means (7) positioned for deactivating adhesive applied on the expiring web from the first roll (2) and not covered by replacement web from the second roll (3).

4. The apparatus of claim 3, further including at least one guide roller (11) for guiding the web in a predetermined path; and wherein the adhesive deactivating means (7) is located between the severing and roll engagement means (5) and said at least one guide roller (11) to deactivate any adhesive on the web passing over the guide roller before the web reaches the guide roller.

5. The apparatus of claim 1, further including a control means (13) for controlling sequencing of operation of pivoting of the frame (1), of said first drive and braking means (4), of said second drive and braking means (8,9), and of the adhesive application means (6).

6. The apparatus of claim 5, further including connections between the control unit (13) and a pivoting means for said frame, said first drive and braking means (4), said second drive and braking means (8, 9), said severing and roll engagement means (5), and said adhesive application means (6).

7. The apparatus of claim 6, further including an adhesive deactivating means (7) positioned for deactivating adhesive applied on the expiring web from the first roll (2) and not covered by replacement web from the second roll (3);

and wherein said control means (13) is further coupled to the adhesive deactivating means (7).

8. The apparatus of claim 5, further including sensing means (15) operatively coupled to the web supplied from one of said rolls, and providing web length signals to said control means.

9. A method of changing moving expiring paper web derived from a first or old roll (2) to moving replacement paper web supplied from a second or replacement roll (3) in a printing roll changer apparatus, said apparatus having a frame (1) which is pivotable about a horizontal axis (A), said frame retaining both said first and second rolls (2, 3);

a first drive and braking means (4) located for surface engagement with one of said rolls and for controlling the speed of the roll upon roll-off of the substrate therefrom;

a second drive and braking means (8, 9) for controlling the speed of one or both of said rolls independently of said first drive and braking means (4);

an adhesive applications means (6); and a roll engagement and severing means (5) positioned for engaging the expiring web of the first roll (2) with the replacement web on the second roll (3) upon adhering the webs of said rolls together when changing over between said rolls, and to sever the expiring web from the first roll (2), and comprising the steps of applying adhesive from said adhesive application means (6) to a portion of the expiring web from the first roll and on that surface of the expiring web of the first roll (2) which faces the replacement web from the second roll (3);

adhering together the expiring web from the first roll (2) which has the adhesive applied thereto onto the surface of the replacement web from the second roll (3) by pressing said webs together by said roll engagement and severing means (5); and severing a trailing region of the portion of the expiring web from the first roll which has adhesive applied thereto during said adhesive application step upon adhesion of the expiring web to the replacement web on the second roll (3) by said roll engagement and severing means (5).

10. The method of claim 9, including the step of deactivating adhesive on said surface of the web from the first roll (2) which is not covered by replacement web from the second roll (3) after said adhesion and severing steps.

* * * * *